US007587052B2

(12) United States Patent
Kasztelan

(10) Patent No.: US 7,587,052 B2
(45) Date of Patent: Sep. 8, 2009

(54) HEARING AID AND METHOD FOR ADJUSTING A HEARING AID

(75) Inventor: Thomas Kasztelan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 832 days.

(21) Appl. No.: 11/132,917

(22) Filed: May 19, 2005

(65) Prior Publication Data

US 2006/0013421 A1 Jan. 19, 2006

(30) Foreign Application Priority Data

May 21, 2004 (DE) ..... 10 2004 025 122

(51) Int. Cl.
*H04R 29/00* (2006.01)
*H04R 5/00* (2006.01)
*H04R 25/00* (2006.01)

(52) U.S. Cl. ..... 381/60; 381/23.1

(58) Field of Classification Search ..... 381/60; 73/645

See application file for complete search history.

(56) References Cited

U.S. PATENT DOCUMENTS 3,784,745 A * 1/1974 Stearns ..... 73/585
4,471,171 A * 9/1984 Kopke et al. ..... 381/60
4,604,616 A * 8/1986 Buchas ..... 345/467
5,325,436 A * 6/1994 Soli et al. ..... 381/313

FOREIGN PATENT DOCUMENTS

DE 199 38 318 A1 3/2001
EP 0 681 411 A1 11/1995

* cited by examiner

*Primary Examiner*—Brian Ensey
*Assistant Examiner*—Matthew Eason

(57) ABSTRACT

The object of the invention is to make the adjustment of a hearing aid more convenient, for which purpose the frequency response data relating to the frequency response individually measured for the present hearing aid (HG) is stored in a memory device (S) of the hearing aid. As a result the length of a sound tube installed in the hearing aid can also be taken directly into account, for example. For the purpose of adjusting the hearing aid, the individual frequency response can then be read out from the hearing aid, thereby enabling the adjustment process to be performed much more quickly.

10 Claims, 2 Drawing Sheets

HEARING AID AND METHOD FOR ADJUSTING A HEARING AID

CROSS REFERENCE TO RELATED APPLICATIONS

This application claims priority to the German application No. 10 2004 025 122.3, filed May 21, 2004 which is incorporated by reference herein in its entirety.

FIELD OF INVENTION

The present invention relates to a hearing aid having a memory device in which data is stored in a form that can be read out. The present invention further relates to a corresponding method for adjusting a hearing aid for a hearing aid wearer.

BACKGROUND OF INVENTION

A hearing aid must essentially be adjusted specifically to suit the individual hearing aid wearer in each case. To facilitate said adjustments, use is made of certain preset values (defaults). Said preset values are stored in the hearing aid in the form, for example, of value tables which have been produced for a particular device type. Fine tuning of the hearing aid can thus be performed more quickly based on these stored values.

For the purpose of adjusting a hearing aid it is helpful if the frequency response of the hearing aid is known at least approximately in advance. For this reason the type-specific frequency response is determined for many hearing aid types during manufacture and provided with corresponding software. The fine adjustment can then be performed more quickly with the aid of the frequency response specific to the hearing aid type.

SUMMARY OF INVENTION

With many hearing aids, however, the type-specific frequency response data provides only very rough points of reference. This is the case in particular with ITE (in-the-ear) hearing aids in which, owing to the individual designs of the otoplastics, the sound tubes in the hearing aids are always of different lengths, even if the same hearing aid types are involved.

In this connection the publication EP 0 681 411, for example, discloses a programmable hearing aid in which hearing aid characteristic data can be stored. For this purpose provision must be made in the hearing aid for a corresponding memory which can be read out as necessary.

An object of the present invention is therefore to improve the adjustment of individual hearing aids.

This object is achieved according to the invention by means of a hearing aid having a memory device in which data is stored in a form that can be read out, the stored data comprising frequency response data relating to the frequency response individually measured for the present hearing aid.

Also provided according to the invention is a method for adjusting a hearing aid for a hearing aid wearer by the reading out, from a memory of the hearing aid, of frequency response data relating to the frequency response individually measured for the present hearing aid and adjustment of the hearing aid using the individual frequency response data.

Thus, the advantage according to the invention resides in the fact that the individual frequency response in each case can be read out directly from the hearing aid, thereby enabling an adjustment to be performed more quickly.

The frequency response is preferably measured in situ, with the result that the frequency response data contains indirect information relating to the auditory canal of the hearing aid wearer. Although a microphone or measuring tube is required in the ear canal in order to perform this measurement, the advantage is that the frequency response is already recorded and stored in the hearing aid taking the specific, acoustic conditions in the wearer's ear canal into account, so that subsequent fine adjustments can be performed more quickly.

The frequency response should be stored at least in the range from 100 Hz to 10 kHz. This then covers the frequency range that is typical for hearing aids.

In a preferred embodiment the frequency response is stored with 10 to 200 sampling values. This number of sampling values is sufficient in order to be able to record the individual frequency response precisely according to the circumstances.

The frequency response data should furthermore be stored in a standardized format. This ensures that the hearing aids can be read out using different software.

BRIEF DESCRIPTION OF THE DRAWINGS

The present invention will now be explained in more detail with reference to the attached drawings, in which.

DETAILED DESCRIPTION OF INVENTION

The exemplary embodiment described in more detail below represents a preferred embodiment of the present invention.

Figure 1:
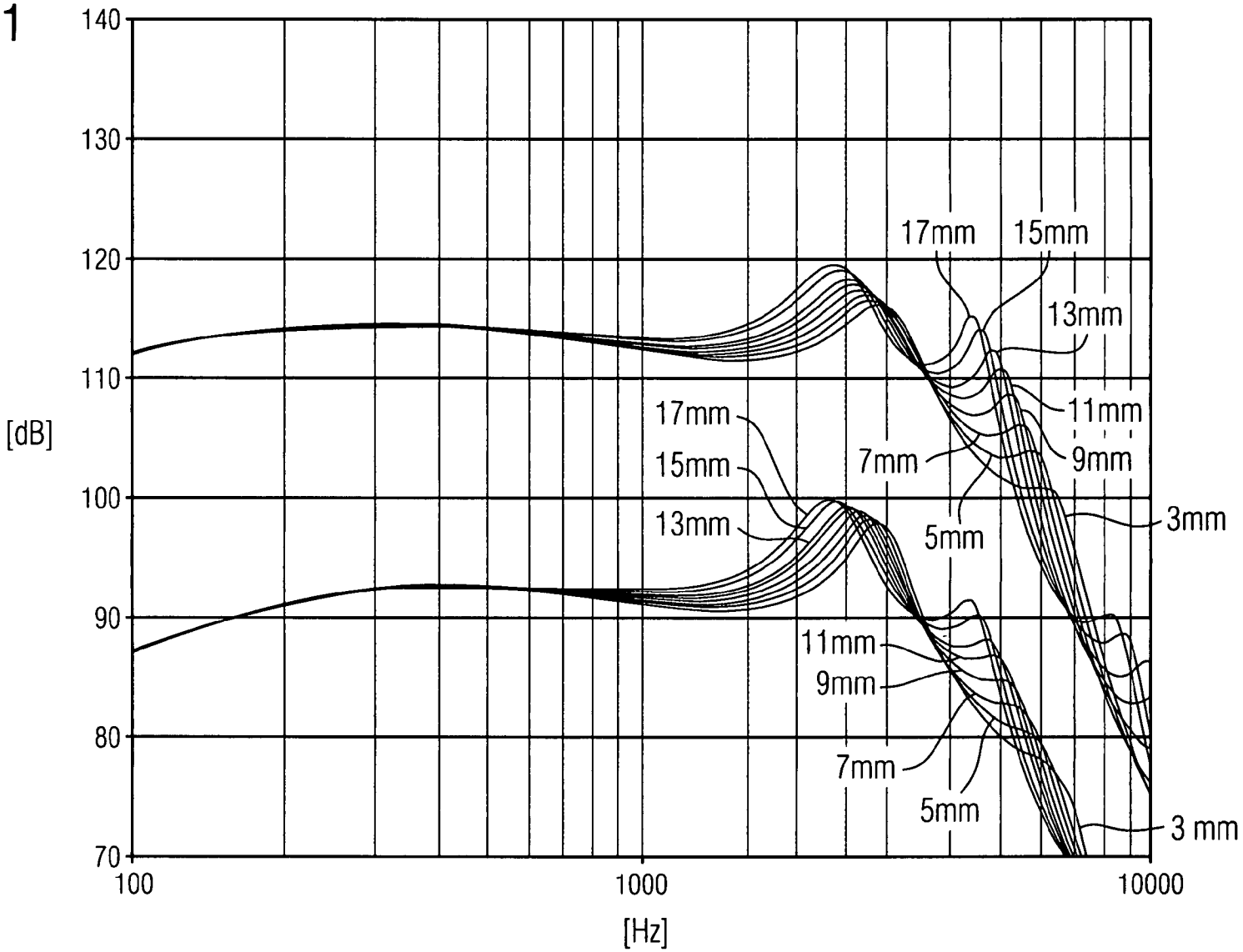
FIG. 1 shows frequency responses of hearing aids with different sound tube lengths and FIG. 2 is a schematic diagram illustrating how an individual frequency response is measured.

The frequency response of a hearing aid is typically measured in the range from 100 Hz to 10 kHz, as shown in the example in FIG. 1. In this case the frequency responses of two different amplification stages are depicted. In each of the two amplification stages the frequency response varies as a function of the length of the sound tube between the earpiece and the ITE hearing aid output. The length of the sound tube is directly dependent on the shape of the otoplastic. The sound tube lengths produce different resonances, which is reflected in the frequency responses. Thus, with the hearing aid measured in FIG. 1, for example, the maximum amplification with a sound tube length of 17 mm is found in the vicinity of approximately 2400 Hz, whereas the maximum amplification for a sound tube length of 3 mm lies in the vicinity of 3000 Hz. Furthermore, the level difference between the two hearing aids having tube lengths of 17 mm and 3 mm respectively is about 11 dB at 4.3 kHz. Needless to say, this significant level difference makes itself clearly noticeable during the adjustment.

Figure 2:
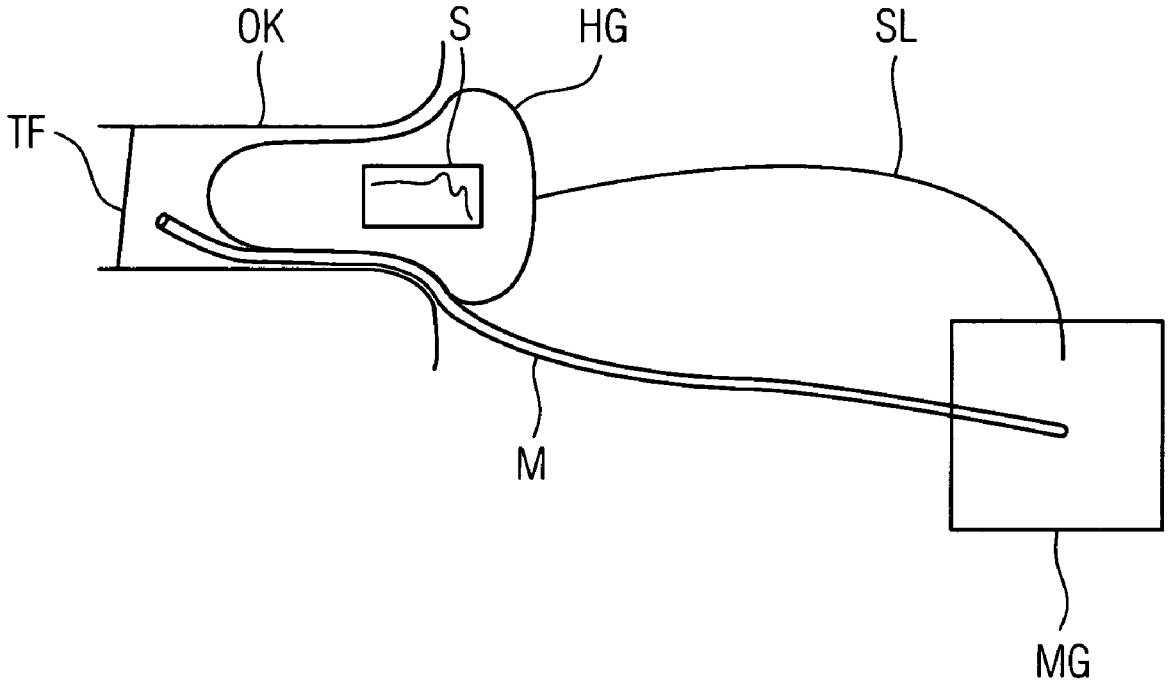

It is therefore provided according to the invention that the individual frequency response of a hearing aid is stored in said hearing aid. Tow ard that end, a laboratory measurement or where applicable an in-situ measurement is performed, as outlined in FIG. 2. In this case an ITE hearing aid HG is inserted in an ear canal OK. The end of a measuring tube M or a microphone is located in the space between the tympanic membrane TF and the hearing aid HG, with the result that the output sound level of the hearing aid HG in the individually shaped ear canal can be measured. For the purpose of recording the frequency response the hearing aid HG is controlled by a measuring device MG via a control line SL. Following the measurement of the individual frequency response by the measuring device MG, the frequency response is stored in a memory S of the hearing aid HG. The frequency response can be transferred from said memory S to the programming device of an audiologist at any given time, for example to allow a readjustment of the hearing aid HG. The memory S in the hearing aid HG is implemented in the form of an EEPROM for example.

In order to adjust a hearing aid, the audiologists or customers need only the software for the programming interface. As a result of the solution according to the invention, the latest frequency response data and updates to this data do not have to be distributed to the audiologists and customers. Rather, the frequency-specific hearing aid curves for each hearing aid are stored directly in the respective hearing aid. This means that the programming software can remain unchanged for different hearing aid types or versions, but also if changes are made to the parameters on the hearing aid. There is therefore no need for a corresponding software distribution action to the relevant users. More particularly, older software can also be used for more recent hearing aids.

However, storing the individual frequency response in the hearing aid also opens up the possibility that any combinations of hearing aid components can be installed in the hearing aid. Each of these components, in particular also the earpieces, have an effect on the individual frequency response, although the latter is now explicitly stored. Finally, the actual component combination is measured in every case and the corresponding frequency response stored in the hearing aid.

The invention claimed is:

1. A hearing aid, comprising:

an in the ear hearing aid device configured for insertion in an auditory canal of a user; and a memory device arranged within the hearing aid device configured for storing and reading out data related to the operation of the hearing aid device, wherein the data includes a frequency response individually measured for the hearing aid device, and the frequency response is measured while the hearing aid is inserted into an auditory canal of a user so that the frequency response includes information on the auditory canal of the user.

2. The hearing aid as claimed in claim 1, wherein the frequency response includes the frequency range from 100 Hz to 10 kHz.

3. The hearing aid as claimed in claim 1, wherein the frequency response is represented by a plurality of frequency sampling values stored in the memory device.

4. The hearing aid as claimed in claim 3, wherein the plurality of frequency sampling values includes between 10 and 200 frequency sampling values.

5. The hearing aid as claimed in claim 1, wherein the frequency response is stored in the memory device using a standardized format.

6. A method of adjusting a hearing aid, the method comprising:

providing a hearing aid;

inserting the hearing aid into an auditory canal of a use;

measuring a frequency response of the hearing aid so that the frequency response includes information on the auditory canal of the user;

storing the frequency response in a memory device of the hearing aid;

reading out the frequency response from the memory device; and adjusting the hearing aid based on the read out frequency response.

7. The method as claimed in claim 6, wherein the frequency response includes the frequency range from 100 Hz to 10 kHz.

8. The method as claimed in claim 6, wherein the frequency response is represented by a plurality of frequency sampling values stored in the memory device.

9. The method as claimed in claim 8, wherein the plurality of frequency sampling values includes between 10 and 200 frequency sampling values.

10. The method as claimed in claim 8, wherein the frequency response is stored in the memory device using a standardized format.

* * * * *